United States Patent [19]

Price

[11] 4,043,487

[45] Aug. 23, 1977

[54] MORTAR APPLYING MACHINE

[76] Inventor: Norris F. Price, Rte. 1, Surgoinsville, Tenn. 37873

[21] Appl. No.: 600,071

[22] Filed: July 29, 1975

[51] Int. Cl.[2] ..... B67D 5/64

[52] U.S. Cl. ..... 222/166; 222/611; 222/200; 401/48

[58] Field of Search ..... 222/176, 178, 200, 202, 222/166, 164, 161, 196, 198, 478, 566; 52/749; 401/48, 4, 193, 28; 214/308, 53; 118/305, 207

[56] References Cited

U.S. PATENT DOCUMENTS

| | | | |
|---|---|---|---|
| 2,591,377 | 4/1952 | Sadler | 401/48 |
| 2,850,052 | 9/1958 | Solie | 222/178 X |
| 3,148,432 | 9/1964 | Garnett, Jr. | 222/178 X |
| 3,162,886 | 12/1964 | Wise | 401/193 X |
| 3,164,301 | 1/1965 | Hargreaves et al. | 222/166 X |
| 3,574,332 | 4/1971 | Wetzel | 214/53 X |
| 3,731,828 | 5/1973 | Clarke et al. | 214/53 X |
| 3,826,410 | 7/1974 | Meyer | 222/179 |
| 3,868,047 | 2/1975 | Bersano | 222/166 |

FOREIGN PATENT DOCUMENTS

| | | | |
|---|---|---|---|
| 907,591 | 3/1954 | Germany | 401/4 |

*Primary Examiner*—Robert B. Reeves
*Assistant Examiner*—Charles A. Marmor
*Attorney, Agent, or Firm*—Victor J. Evans & Co.

[57] ABSTRACT

A mortar applying machine including a base supported on rollers adapted to roll along the top of a brick or block wall with one of the rollers being driven to move the machine horizontally along the wall. Guide rollers extend downwardly from the base to engage the sides of the wall to maintain the machine in proper alignment. A hopper is mounted on the base and is angularly adjustable to assist in controlling the flow of mortar therefrom. A vibrator is attached to the hopper to assist in moving the mortar from the hopper. A pair of oppositely extending nozzles project from the hopper to feed the mortar to the side edges of the wall. The hopper and vibrator can be removed as a unit from the machine to apply mortar in positions where the machine cannot be used due to space restrictions. When using the hopper removed from the machine one of the nozzles is blocked so that only one stream of mortar issues from the hopper.

4 Claims, 10 Drawing Figures

FIG. 1.
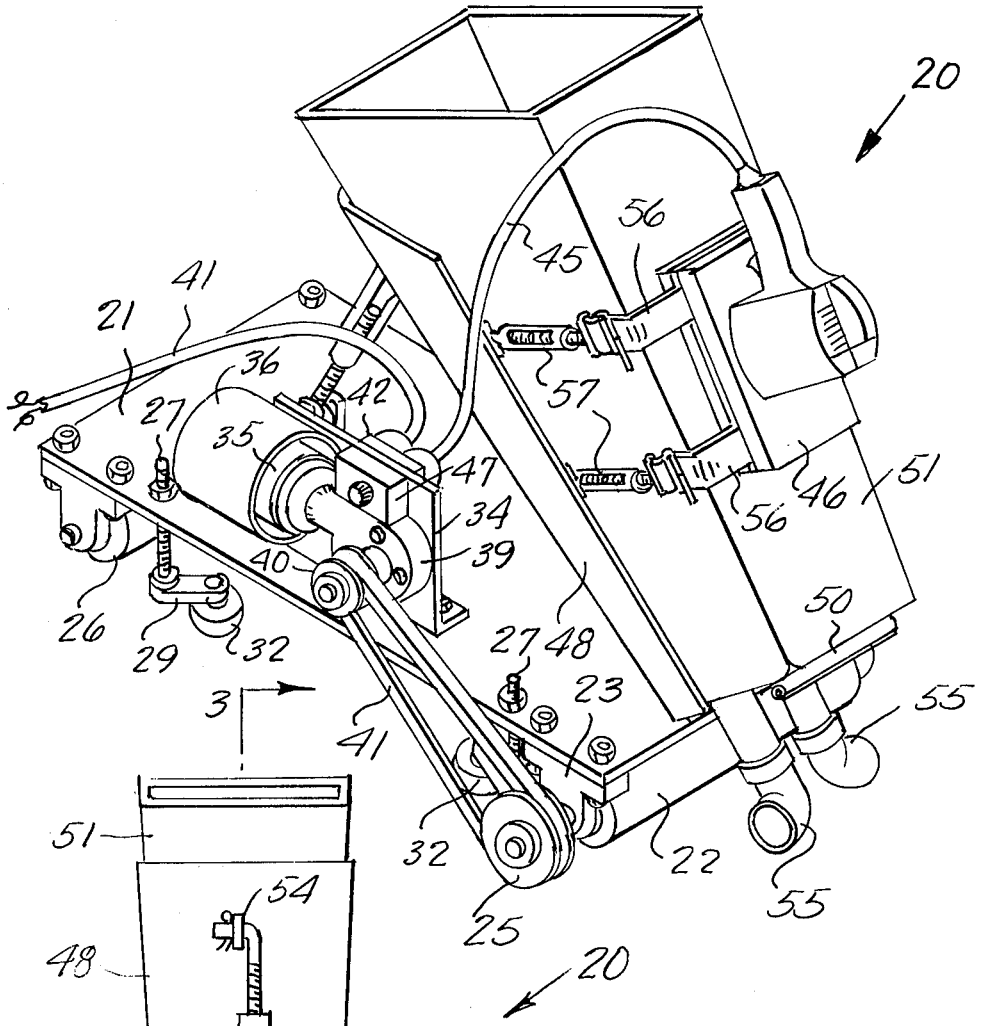
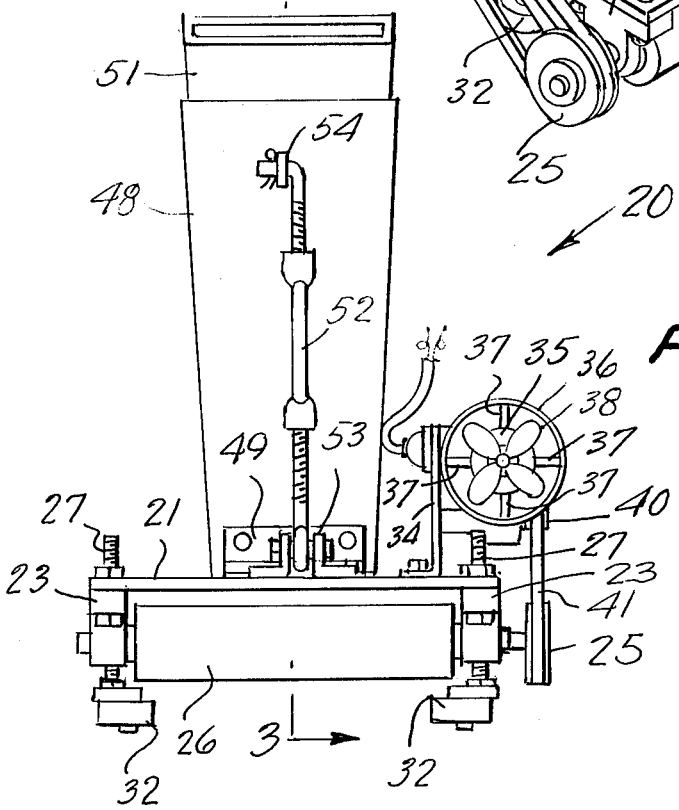
FIG. 2.

FIG. 5.
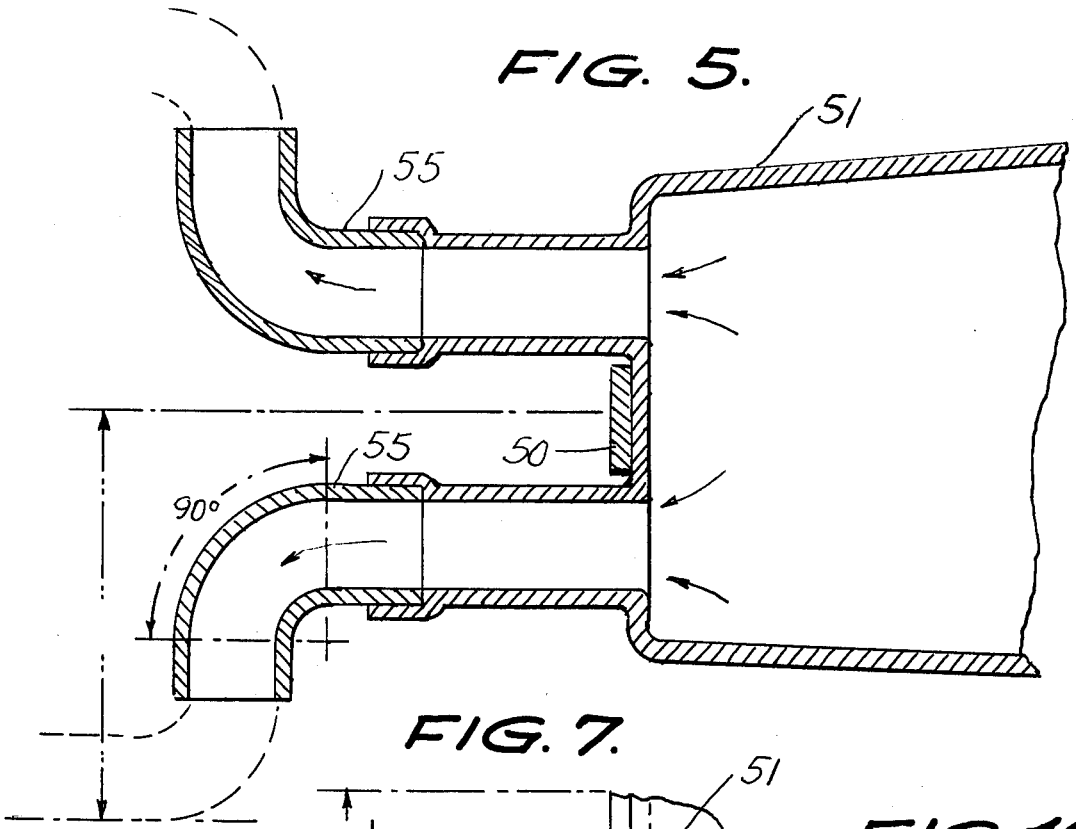
FIG. 7.
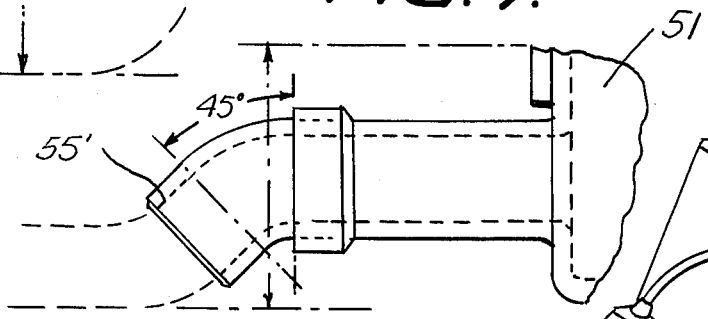
FIG. 10.
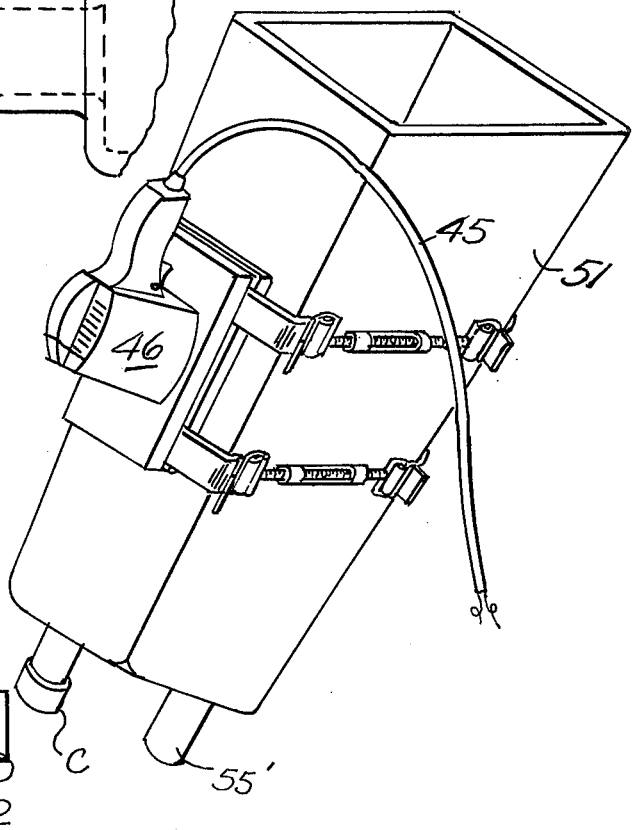
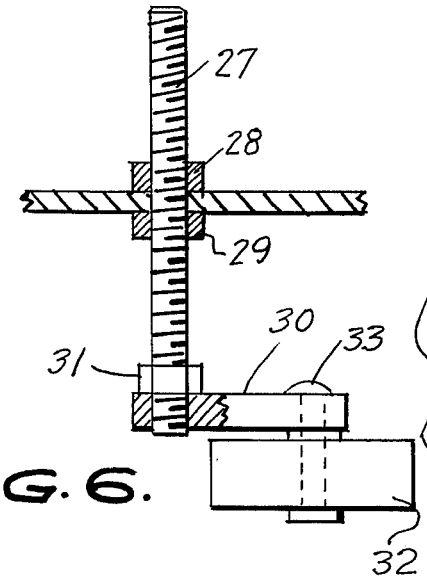
FIG. 6.

MORTAR APPLYING MACHINE

BACKGROUND OF THE INVENTION

FIELD OF THE INVENTION

The present invention relates to mortar applying machines for use on brick, concrete block, cinder block and other masonry walls wherein each course is generally flat and generally horizontal.

SUMMARY OF THE INVENTION

The mortar applying machine of the instant invention includes a base supported on a pair of rollers with one of the rollers being driven from an electric motor in order to move the machine along the top of a masonry wall. Guide rollers are fixed to the side of the base and are adjustable to fit walls of various thicknesses. A hopper is hingedly secured to one end of the base and has the opposite end elevated by adjustable means so as to change the angle of the hopper with respect to the base thus controlling the flow of material from the hopper. A pair of oppositely extending nozzles are secured to the hopper for laying a pair of mortar rows on the outside edges of the masonry wall. A vibrator is attached to the hopper for vibrating the hopper and increasing the flow of mortar therefrom.

The primary object of the invention is to provide a mortar applying machine which is self-propelled along the top of the masonry wall and applies a uniform line of mortar along each side edge of the masonry wall.

Other objects and advantages will become apparent in the following specification when considered in light of the attached drawings.

BRIEF DESCRIPTION OF THE DRAWINGS

FIG. 1 is a perspective view of the invention;

FIG. 2 is a rear elevation of the invention;

FIG. 5 is an enlarged fragmentary transverse sectional view taken along the line 5—5 of FIG. 3 looking in the direction of the arrows;

FIG. 6 is an enlarged fragmentary vertical sectional view taken along the line 6—6 of FIG. 4 looking in the direction of the arrows;

FIG. 7 is a detailed view of a modified form of nozzle;

FIG. 10 is a perspective view of the hopper, vibrator and single nozzle removed from the machine for use in restricted spaces.

DESCRIPTION OF THE PREFERRED EMBODIMENT

Figure 3:
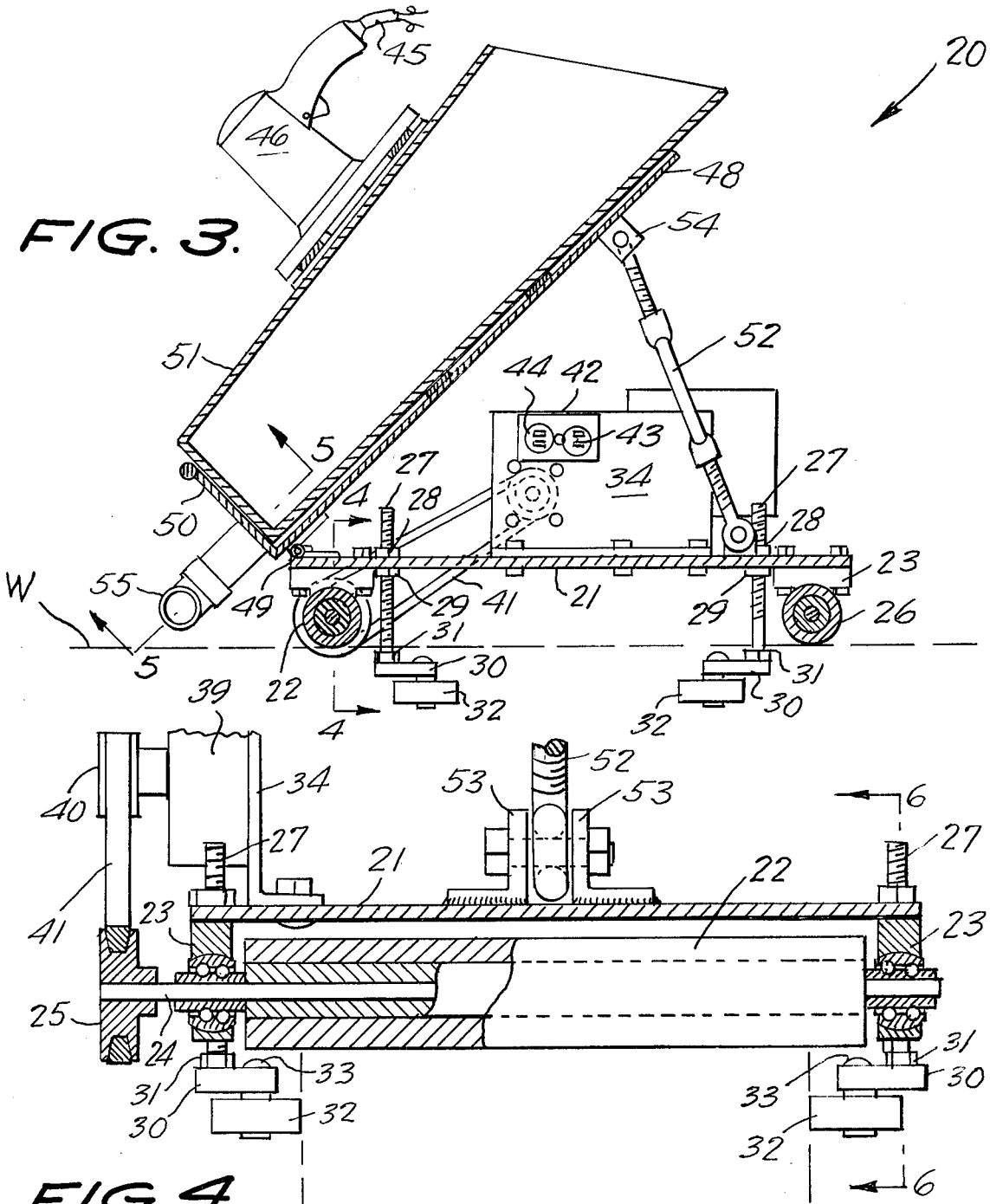
FIG. 3 is a longitudinal sectional view taken along the line 3—3 of FIG. 2 looking in the direction of the arrows.
Figure 4:
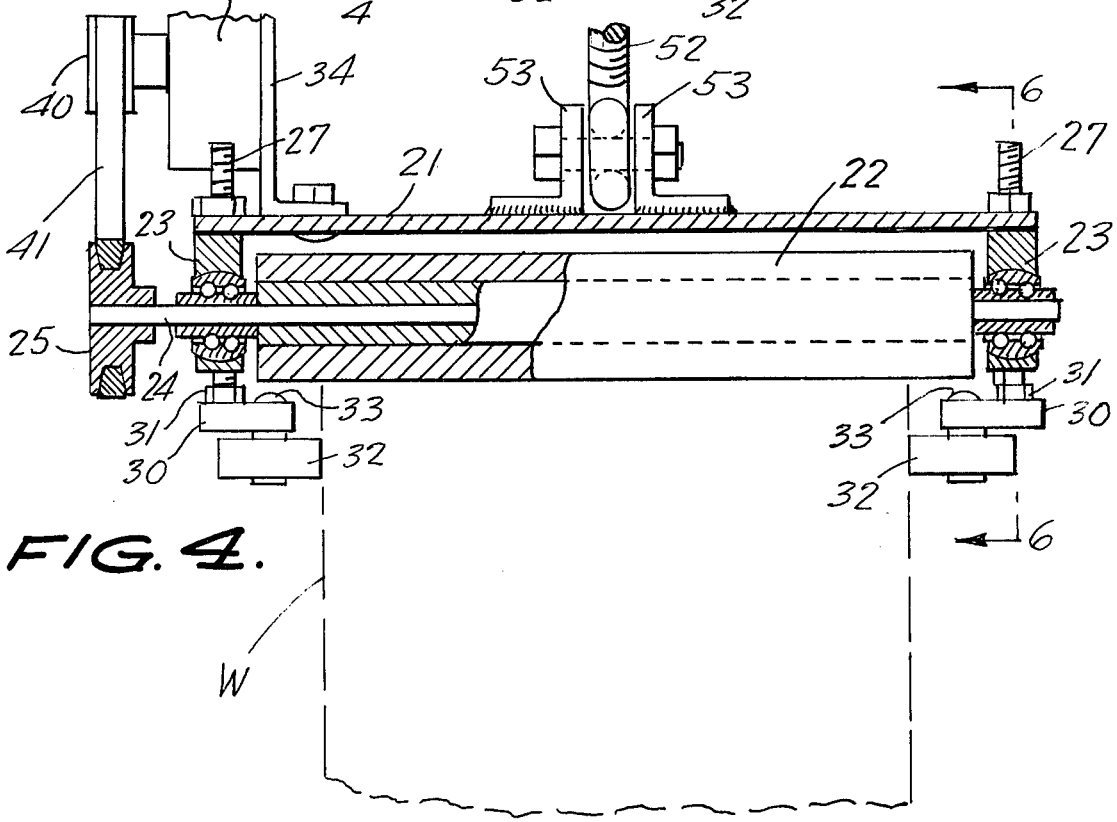
FIG. 4 is an enlarged fragmentary vertical sectional view taken on the line 4—4 of FIG. 3 looking in the direction of the arrows.

Referring now to the drawings in detail wherein like reference characters indicate like parts throughout the several FIGS. the reference numeral 20 indicates generally a mortar applying machine constructed in accordance with the invention.

The machine 20 includes a generally rectangular base plate 21 having a forward roller 22 positioned beneath its forward end and supported on bearings 23 at opposite ends thereof. The roller 22 has a guide shaft 24 extending from one end thereof with a pulley 25 secured thereto.

A rear roller 26 is positioned beneath the rear end of the base plate 21 and is supported on a pair of bearings 23 at opposite ends thereof. The roller 26 has its axis parallel to the roller 22 and is freely rotatable in its bearings 23. A pair of threaded shafts 27 are mounted in the base plate 21 and are secured in place by a pair of lock nuts 28-29 engaging the upper and lower surfaces of the base plate 21. A crank arm 30 is secured to each of the threaded shafts 27 and is locked in position thereon by a lock nut 31. A freely rotatable roller 32 is secured to the crank arm 30 by a pivot shaft 33. The relative position of the rollers 32 can be adjusted by loosening the lock nut 31 and rotating the crank arm 30 to bring the rollers 32 to the desired position. When the rollers 32 have reached the desired position the lock nut 31 can be tightened to maintain the rollers 32 in this position. If it is desired to raise or lower the rollers 32 the lock nuts 28-29 can be loosened and the shaft 27 moved downwardly or upwardly as desired.

A mounting bracket 34 is secured to the base plate 21 and extends upwardly therefrom for reasons to be assigned. An electric motor 35 is secured in a cylindrical housing 36 by a plurality of struts 37 and has a fan 38 secured to one end thereof to draw air between the motor 35 and the housing 36 in order to keep the motor 35 at a proper operating temperature. A worm gear drive 39 is secured to the motor 35 and has a drive pulley 40 mounted thereon. A belt 41 extends from the pulley 25 to the pulley 40 so as to drive the roller 22 when the motor 35 is energized.

A power supply line 41 extends to an electric box 42 mounted on the bracket 34 and is plugged into a receptacle 43. A second receptacle 44 is provided for plugging in the supply line 45 of the vibrator 46. A rheostat 47 is mounted on the bracket 34 and communicates with the electric box 42. The rheostat 47 energizes the receptacle 44 and can be adjusted to regulate the speed of the vibrator 46 to control the flow of mortar as required. The drive motor 35 can be selectively plugged into the receptacle 44 when it is desired to control the speed of the machine 20 on the wall W.

A tray 48 is secured to one end of the base 21 by means of a hinge 49. The tray 48 has an end support 50 for preventing the hopper 51 from moving downwardly in the tray 48 behond the desired point. The tray 48 is supported at an angle above the base 21 by means of a turnbuckle 52 secured to ears 53 on the base plate 21 and to an ear 54 on the upper portion of the tray 48. Adjustment of the turnbuckle 52 causes the tray to tilt with respect to the base 21 to increase or decrease the flow rate from the hopper 51. A pair of oppositely extending nozzles 55 are secured to the lower end of the hopper 51 for applying mortar to the outer edges of the top of a wall W.

The vibrator 46 is secured to the hopper 51 by means of straps 56 combined with turnbuckles 57 which can be tightened or loosened as required for maintaining the vibrator 46 in tight engagement with the hopper 51. The nozzles 55 project at a 90° angle in opposite directions. In FIG. 7 a modified form of the invention is illustrated where nozzles 55' project at a 45 ° angle in opposite directions.

Figure 8:
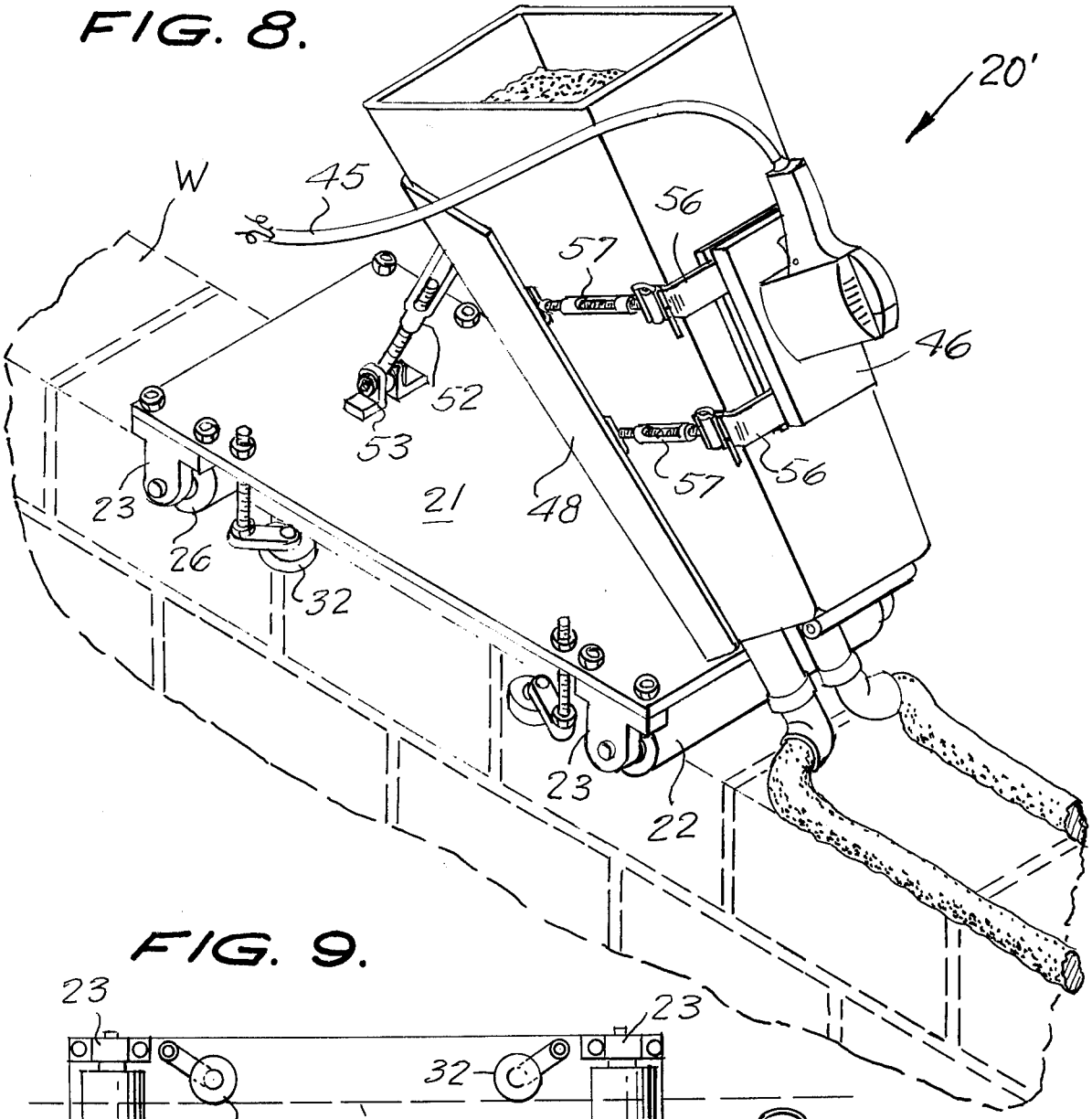
FIG. 8 is a view similar to FIG. 1 of a hand-propelled version of the machine.
Figure 9:
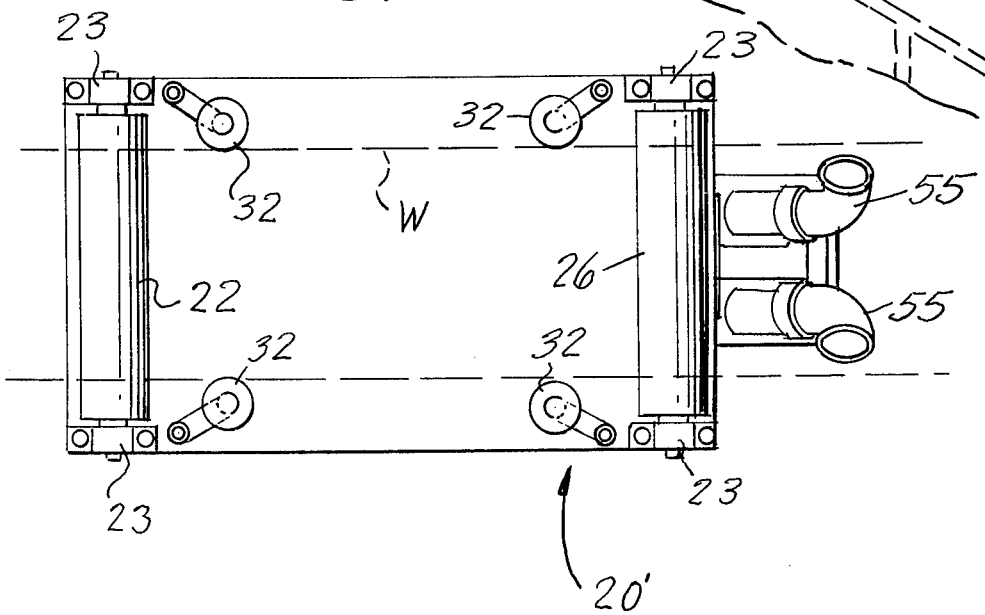
FIG. 9 is a bottom plan view of the structure illustrated in FIG. 8.

In FIGS. 8 and 9 a modified mortar applying machine 20' is illustrated which is identical in every respect with the mortar applying machine 20 except that the motor drive and bracket 34 have been completely eliminated with the vibrator 46 being connected to a source of electricity (not shown).

The use and operation of the mortar applying machine 20' is identical to that the mortar applying machine 20 with the exception that the rollers 22-26 move freely and the machine 20' is hand propelled along the top of the wall W.

In FIG. 10 the hopper 51 has been removed from the tray 48 and the vibrator 46 has been plugged into a source of electricity (not shown). The nozzle 55' provides an outlet for mortar from the hopper 51 and a cap C has closed the outlet from the hopper 51 for the second nozzle 55. The modified form of the invention as illustrated in FIG. 10 is used for laying by hand a single line of mortar along a relatively narrow brick wall where restricted space prevents the use of the mortar machine 20 or the mortar machine 20'.

Having thus described the preferred embodiments of the invention it should be understood that numerous structural modifications and adaptations may be resorted to without departing from the spirit of the invention.

What is claimed is:

1. A mortar applying machine including a generally rectangular horizontal base plate, a pair of rollers extending transversely across said base plate at each end thereof supporting said base plate on the top of a masonry wall, means on said base plate for rotating one of said rollers to move said base plate along the masonry wall, guide rollers secured to opposite sides of said base plate for engaging the sides of the masonry wall to guide the base plate along the masonry wall, a hopper, a hinged tray for removably mounting said hopper on said base plate at one end thereof, hinge means connecting said tray to said base plate, at least one discharge opening in the bottom of said hopper positioned at one end of said base plate, and means extending upwardly from said base plate to adjustably secure the end of said tray remote from said hinge means for adjustably positioning said hopper at an angle to said base plate.

2. The device as claimed in claim 1 in which said means for rotating one of said rollers is an electric motor.

3. The device as claimed in claim 1 in which a vibrator is secured to said hopper when the device is in operation to cause the mortar to flow from said hopper.

4. The device as claimed in claim 1 in which a nozzle is mounted on the discharge opening in said hopper to direct the flow of mortar from said hopper to an edge of the wall on which said base plate is supported.

* * * * *